United States Patent [19]

Duerr et al.

[11] 4,121,401

[45] Oct. 24, 1978

[54] METHOD AND APPARATUS FOR APPLYING REINFORCING STRIPS TO ADJACENT PAIRS OF CONTAINERS

[75] Inventors: Joseph W. Duerr, Rockleigh; Robert H. Ganz, Saddle River, both of N.J.

[73] Assignee: Ganz Brothers, Inc., Bergenfield, N.J.

[21] Appl. No.: 800,426

[22] Filed: May 25, 1977

[51] Int. Cl.[2] ..... B65B 21/00

[52] U.S. Cl. ..... 53/398; 53/48; 53/49; 53/580

[58] Field of Search ..... 53/35, 48, 49, 196, 53/296, 297, 289

[56] References Cited

U.S. PATENT DOCUMENTS

| | | | |
|---|---|---|---|
| 3,946,535 | 3/1976 | Bourgeois et al. | 53/48 X |
| 4,018,027 | 4/1977 | Curry et al. | 53/48 |

*Primary Examiner*—Travis S. McGehee
*Attorney, Agent, or Firm*—Charles E. Brown

[57] ABSTRACT

This relates to the formation of packages of containers, particularly those formed by heat shrinking a plastics material wrap around a plurality of containers and wherein the package is intended to be picked up by engaging an upper central portion of the wrap. A reinforcing strip is interlocked with upper portions of central ones of the containers. The reinforcing strip is divided in roll form and is first perforated to interlock with upper portions of containers, then is applied to adjacent pairs of containers followed by pressing the reinforcing strip down to assure interlocking thereof with two adjacent containers of two adjacent pairs of containers with the strip being severed between the two adjacent containers while held in place relative thereto. The containers are continuously moving during the application of the reinforcing strip and a single movable support is provided for all of the apparatus components. The movable support is driven by a plurality of cooperating cranks.

23 Claims, 3 Drawing Figures

METHOD AND APPARATUS FOR APPLYING REINFORCING STRIPS TO ADJACENT PAIRS OF CONTAINERS

This invention relates in general to new and useful improvements in container packages, and more particularly to container packages of the type wherein a plurality of containers are formed into a package by wrapping a plastics material sheet around the containers and then heat shrinking the sheet. The upper portion of the wrap is provided with finger openings for engaging a central portion of the wrap.

It has been found in the past that packages of the aforedescribed type have a deficiency in that when the sheet material is maintained at a thinness sufficient to form the package, the central portion thereof does not necessarily have sufficient strength to resist tearing or stretching. In the past, attempts have been made to solve the problem by applying a paperboard reinforcing strip to the central containers with the reinforcing strip being interlocked with the upper portions of the containers. However, it has been found that such paperboard reinforcing strips are relatively expensive and this practice has been generally discontinued.

In accordance with this invention, it is proposed to provide a reinforcing strip in the form of a strip formed of plastics material, which strip is provided in roll form and is applied to pairs of containers which become central containers of a package. The reinforcing strip may be applied to a single line of containers or to dual lines of containers. In other words, if the package is a six-pack, the reinforcing strip will be applied to only the central containers, but if the package is an eight-pack, the reinforcing strip would be applied to the four central containers.

In accordance with the invention, the reinforcing strip is feed between two pairs of feed rolls and while so supported is perforated to have formed therein cuts which are of a shape to be interlocked with upper portions of containers, such as bottles and cans, with closure caps. The reinforcing strip is then directed to a row of moving containers and is pressed against the upper ends of a pair of containers by means of blades moving down between adjacent pairs of containers. Thereafter, the strip is positively engaged by direct pressing members in alignment with upper ends of two adjacent containers of two adjacent pairs of containers to assure the interlocking of the strip with the upper portions of the containers. At this time, the strip is severed between the two adjacent pairs of containers.

In accordance with this invention, the containers are constantly moving and the strip is advanced by the forward unsevered portion of the strip having been interlocked with the moving containers.

In accordance with the invention, all of the elements which operate on the strip are carried by a single movable support which is mounted for movement both towards the line of moving containers and in the same direction and at the same rate as the moving containers.

Finally, there is provided a drive mechanism for the movable support which includes a plurality of cranks operable to both vertically reciprocate the movable support and to effect the control of the longitudinal movement of the movable support.

With the above, and other objects in view that will hereinafter appear, the nature of the invention will be more clearly understood by reference to the following detailed description, the appended claims and the several views illustrated in the accompanying drawing.

Figures 1, 2, 3:
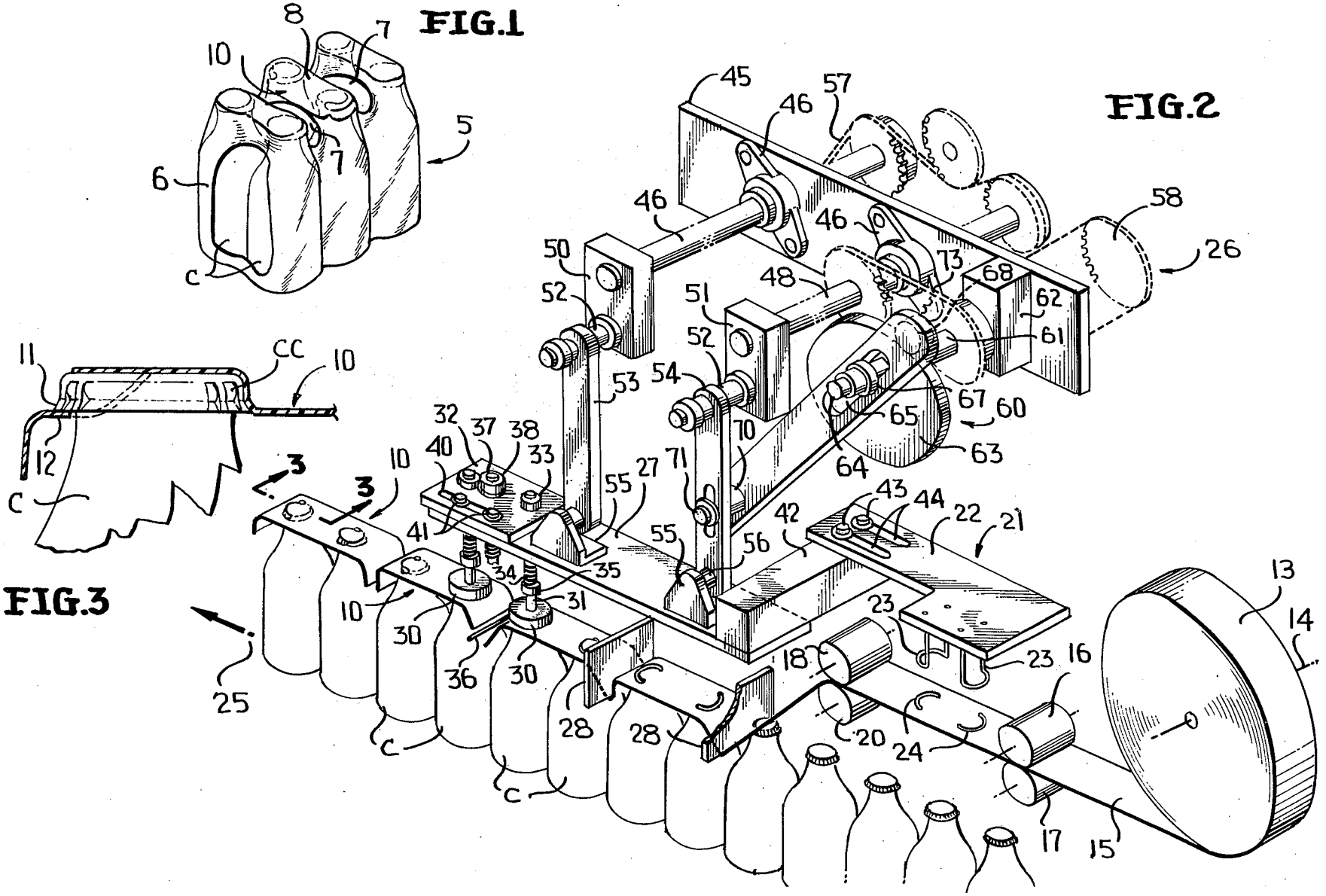
FIG. 1 is a perspective view of a package having applied thereto a reinforcing strip in accordance with the invention.
FIG. 2 is a schematic perspective view showing the reinforcing strips forming and applying mechanism and the sequence of the application of the reinforcing strip to adjacent pairs of containers in a row.
FIG. 3 is an enlarged fragmentary sectional view taken along the line 3—3 of FIG. 2 and specifically shows the interlocking relationship of a reinforcing strip with a closure cap of a bottle.

Referring now to the drawings in detail, it will be seen that there is illustrated in FIG. 1 a six-pack of containers, the package being generally identified by the numeral 5 and the containers being identified by the reference letter C. The containers C are formed into the package 5 by wrapping a sheet of plastic material around the containers, bonding together the overlapped ends of the sheet, and heat shrinking the sheet material around the containers C in a conventional manner to form a plastic wrap 6. The upper portion of the wrap 6 is provided with finger receiving openings 7 with the portion of the wrap therebetween defining a pick up area 8. In accordance with this invention, the pick up area 8 is reinforced by the application of a reinforcing strip, generally identified by the numeral 10, to the two central containers with the reinforcing strip 10 being interlocked with upper portions of such containers.

With particular reference to FIG. 3, it is to be understood that the containers C will normally be in the form of bottles and will be divided with closure caps CC. The closure caps will define a projection 11 under which the reinforcing strips 10 may be interlocked as shown at 12 in FIG. 3.

At this time it is pointed out that although the illustrated containers C are bottles and the closure caps CC are crown caps, the containers may be in the form of metal containers and the closure caps may be in the form of the usual twist-off releasable type closures.

It is to be understood that the reinforcing strip 10 is formed of plastics material and is provided in roll form, such as the roll 13. The roll 13 will be mounted on a suitable support for rotation about an axis 14 in a manner to permit the continuous paying out of the reinforcing strip.

The continuous strip, identified by the numeral 15, is drawn from the roll 13 by means of a pair of cooperating feed rolls 16 which are driven in unison in a customary manner. Downstream of the feed rolls 16, 17 is a second pair of feed rolls 18, 20 which draw the strip 15 from the feed rolls 16, 17. The feed rolls 18, 20 are also driven in a conventional manner and the peripheral rate of drive of the feed rolls 18, 20 may be slightly greater than that of the feed rolls 16, 17 so that the strip 15 is supported between the two pair of feed rolls under slight tension.

Positioned in overlying relation to the path of movement of the strip 15 between the two pair of feed rolls is a perforating mechanism, generally identified by the numeral 21. The perforating mechanism 21 includes a support plate 22 which has mounted on the underside thereof in depending relation a pair of heated wires 23, the heated wires 23 being heated in the conventional manner and being particularly configurated to form a pair of oppositely opening C-shaped cuts or perforations 24 in the strip 15.

It is to be understood that the strip 15 is in overlying aligned relation with respect to a row of the containers C. The row of containers C is a continuously moving row with the containers C being supported on a conveyor 25 of any customary type. All of the containers C may either be in touching relation or feed by the conveyor 25 in slightly spaced pairs.

The reinforcing strip feeding, forming and applying apparatus is generally identified by the numeral 26 and in addition to the perforating apparatus 21 includes applying means and severing means, all carried by a movable support 27 which overlies the row of containers C and is mounted for movement towards and away from the containers and longitudinally of the path of containers at the same rate of movement as that of the containers.

Suitably secured to the underside of the movable support 27 is a pair of depending plates or blades 28 which are so positioned on the support 27 so as to move down between containers of adjacent pairs of containers. The blades 28 serve to press the upper central part of the strip portion disposed therebetween against the upper portions of the containers C and generally effect an interlocking of the strip portion with the closure caps of the associated containers.

As will be obvious from the following description, the strip 15 has already been interlocked with previous pairs of containers so that the strip 15 is drawn from the feed rolls 18, 20 by the moving containers. Thus the blades 28 may readily tension the part of the strip disposed between the blades.

Also carried by the movable support 27 is a pair of pressure members 30 which are spaced apart and are so positioned relative to the blades 28 wherein one pressing member engages the strip 15 in alignment with the closure cap of a trailing container of that pair while the other pressure member engages the strip 15 in overlying relation to the closure cap of a leading container of a trailing pair of containers. The trailing pair of containers are disposed in advance of the pair of containers between the blades 28. Thus the strip 15 is brought into engagement simultaneously with three pairs of containers prior to the severing of the strip 15 to form the reinforcing strip 10.

The pressure members 30 are so contoured to assure that the pressing of the strip 15 down with respect to the closure caps of the containers to effect the interlock of FIG. 3.

Each pressure member 30 is carried by a rod 31 which passes upwardly through a longitudinal slot (not shown) in the support member 27 and is journaled in a mounting plate 32. The upper portion of each rod 31 is provided with a collar 33 which engages the plate 32 to limit the downward position of the pressure member 30 with respect to the support 27. Beneath the support 27, the rod 31 is provided with a spring 34 which engages the underside of the support 27. The lower end of the spring 34 engages a collar 35 on the rod 31 above the pressure member 30 whereby the spring 34 constantly urges the pressure member 30 downwardly to the position where the collar 33 engages the plate 32. When the pressure member 30 is engaged with the strip 15 in overlying relation to the upper part of a container C, after initial limited downward movement as required to interlock the strip 15 with the closure cap CC of the container, the pressure member 30 will be resiliently held in place and the movable support 27 may continue its downward movement.

At this time it is to be understood that the blades 28, together with the pressure member 30, form the applying means of the apparatus 26.

The apparatus 26 also includes severing means in the form of a heated wire having a horizontal lower portion 36. The wire 36 is carried by a rod 37 which also passes through the slot in the movable support 27 and is journaled in the plate 32. The wire is normally vertically positioned with respect to the movable support 27 by means of a collar 38 carried by the upper end of the rod 37. While the heated wire may be fixed relative to the movable support 27 and the plate 32, it also may be resiliently mounted in the manner described with respect to the pressure members 30.

The plate 32 is provided with a longitudinal slot 40 to which securing fasteners 41 pass so that the plate 32 may be longitudinally adjusted with respect to the movable support 27.

It is to be understood that in the operation of the apparatus 26, when the pressure members 30 engage the strip 15 and assure the interlocking of the strip 15 with the closure caps of the containers, the strip 15 is fixedly positioned relative to the containers and at this time further downward movement of the movable support 27 will result in the horizontal portion 36 of the heated wire engaging the strip 15 and severing the same into the individual reinforcing strips 10.

It is also pointed out at this time that the mounting plate 22 is adjustably carried by the movable support 27. To this end, the movable support 27 is provided with a bar 42 to which the plate 22 is secured by means of a pair of fasteners 43, the fasteners 43 passing through slots 44 in the plate 22 so as to permit the longitudinal adjustment of the plate 22. In this manner, the strip 15 may be perforated at the proper position for later alignment with the closure caps of the underlying containers.

It is to be understood that the apparatus 26 is carried by suitable supports of which only a single support plate 45 is illustrated. Preferably there will be two of the support plates 45 in parallel relation. Carried by each of the support plates 45 are bearings 46 for a pair of horizontal shafts 47, 48. The shafts 47, 48 are crankshafts and the ends of the shaft carry crank arms 50, 51 respectively. The crank arms 50, 51 carry crank pins 52 on which the upper ends of depending support links 53, 54 are pivotally mounted. The upper surface of the movable support 27 has suitably secured thereto brackets 55 which are provided with pivot pins 56 pivotably receivig the lower ends of the links 53, 54 thus supporting the movable support 27 in a horizontal position depending from the crank arms 50, 51.

The shafts 47, 48 are driven by means of a chain and sprocket drive 57 which includes a primary drive sprocket 58. It is to be understood that the primary drive sprocket 58, the conveyor 25 and the pairs of feed rolls 16, 17 and 18, 20 will all be driven from a single power source (not shown) so that all of the drives of the apparatus will be synchronously effected.

The drive means of the apparatus 26 also includes a control crank assembly, generally identified by the numeral 60. The control crank assembly 60 includes a shaft 61 which is mounted in a suitable bearing block 62 carried at least by the illustrated support plate 45. The shaft 61 has mounted thereon for rotation therewith a cam disk 63.

The cam disk 63 is provided with an eccentrically mounted crank pin 64 which passes through a slot 65 in the upper part of a control link 66. The control link 66 is retained on the pin 64 by means of a retainer 67. A cam follower 68, carried by the upper portion of the control link 66, rides on the outer surface of the cam disk 64.

The lower end of the control link 66 is provided with a sleeve 70 which pivots on a pivot pin 71 which is adjustable carried by the link 54. The link 54 is provided with an elongated slot 72 which permits the adjustment of the pivot pin 71 longitudinally of the link 54.

The shafts 48 and 61 are drivingly interconnected by means of a drive in the form of a chain and sprocket drive 73.

It will be readily apparent that the rotation of the shafts 47, 48 and the coupling of the movable support 27 to the crank arms 50, 51 thereof is such that the movable support 27 will reciprocate up and down generally in a vertical plane passing through the row of containers C. However, because of the pivotal mounting of the links 53, 54, the movable support 37 would normally be free to be swung in that plane. It will be readily apparent that the crank arms 50, 51 provide for the up and down movement of the support 27 while the crank assembly 60 provides for the forward and back motion of the support 27 so that the support 27, when the elements carried thereby are engaged with the strip 15, is moved forwardly at the same rate as the rate of movement of the containers by the conveyor 25.

OPERATION

The operation of the apparatus is automatic. The strip 15 is drawn from the roll 13 by the feed rolls 16, 17 and is tensioned by the feed rolls 18, 20 between the feed rolls 16, 17 and the feed rolls 18, 20. The necessary C-shaped cuts 24 are formed in the strip 15. The perforated strip 15 passes out of the feed rolls 18, 20 and thereafter is under the control of the moving containers C.

It will be readily apparent that the strip 15 is engaged simultaneously with three pairs of containers before it is severed by the heated wire horizontal portion 36. While the unsevered portion of the strip 15 is interlocked with the containers of the first two pair of containers, the strip is drawn down over the upper portion of the third pair of containers by the blades 28. Interlocking of the strip with the projecting upper portions of the containers is insured by the pressure members 30 and full control over the strip is maintained by the pressure members 30 at the time the strip 15 is severed into the individual reinforcing strips 10.

At this time it is pointed out that, if desired, the strip 15 may be formed of the same plastic material as the wrap 6, or one compatible therewith, so that at the time the wrap 6 is shrunk about the containers C, it will also bond, at least to a limited degree, to the reinforcing strip 10.

It is also pointed out here that although only a single row of containers C have been illustrated, normally at the time the strip 15 is applied to the containers, the containers will have been grouped or assembled in the desired number of rows in accordance with the number of containers to be packaged. In other words, if the package is to be a six-pack, then there will be three rows of the containers. On the other hand, if the package is to be an eight-pack, there will be four rows of the containers. In a like manner, if there are four rows of containers, the strip 13 will be of greater width, there will be four of the heated wires 23 so as to form four C-shaped cuts 24. Also, there will be four of the pressure members 30 and the blades 28 and the heated wire portion 36 will be made wider.

Although in a preferred embodiment of the invention as has been specifically illustrated and described herein, it is to be understood that minor variations may be made in the apparatus and the method of forming and applying the strip without departing from the spirit and scope of the invention, as defined by the appended claims.

I claim:

1. Apparatus for applying a package reinforcing strip to pairs of containers of the type having an upper portion with a peripheral projection, said apparatus comprising mounting means for mounting a continuous unperforated reinforcing strip supply, perforating means for serially perforating portions of a reinforcing strip carried by said mounting means, applying means for engaging each perforated strip portion and pressing the same over upper portions of a pair of adjacent containers, severing means for severing an applied strip portion from the remainder of a strip, and feed means for advancing containers along a predetermined path in a row, said feed means defining means for drawing a strip from said strip supply.

2. Apparatus according to claim 1 wherein said feed means is of the continuous feeding type.

3. Apparatus according to claim 2 wherein there are means mounting said perforating means for movement both towards a strip and in the direction of strip movement.

4. Apparatus according to claim 2 wherein there are means mounting said applying means for movement both towards a strip and underlying containers and in the direction of strip movement.

5. Apparatus according to claim 2 together with mounting means mounting said perforating means and said applying means for movement in unison towards a strip and in the direction of strip movement.

6. Apparatus according to claim 5 wherein said mounting means includes a single carrier for said perforating means and said applying means.

7. Apparatus for applying a package reinforcing strip to pairs of containers of the type having an upper portion with a peripheral projection, said apparatus comprising perforating means for perforating a reinforcing strip portion, applying means for engaging a perforated strip portion and pressing the same over upper portions of a pair of adjacent containers, severing means for severing an applied strip portion from the remainder of a strip, means mounting said applying means for applying a perforated strip portion to a second pair of containers while connected to a strip portion to a preceeding first pair of containers, and means mounting said severing means for severing a strip between first and second pair of containers.

8. Apparatus for applying a package reinforcing strip to pairs of containers of the type having an upper portion with a peripheral projection, said apparatus comprising perforating means for perforating a reinforcing strip portion, applying means for engaging a perforated strip portion and pressing the same over upper portions of a pair of adjacent containers, severing means for severing an applied strip portion from the remainder of a strip, said perforating means includes spaced pairs of feed rolls for receiving a reinforcing strip therebetween in supported relation, a pair of perforating members, and movable support means for moving said perforating members into engagement with a reinforcing strip portion supported between said pairs of feed rolls.

9. Apparatus according to claim 8 wherein said feed rolls are constantly driven to constantly move a reinforcing strip portion supported therebetween, and said movable support has means for moving said movable support in the same direction and at the same rate as the moving reinforcing strip portion.

10. Apparatus for applying a package reinforcing strip to pairs of containers of the type having an upper portion with a peripheral projection, said apparatus comprising perforating means for perforating a reinforcing strip portion, applying means for engaging a perforated strip portion and pressing the same over upper portions of a pair of adjacent containers, and severing means for servering an applied strip portion from the remainder of a strip, said applying means including drawing means for drawing a perforated strip portion down between adjacent pairs of containers at opposite ends of a pair of containers to which a reinforcing strip portion is being applied.

11. Apparatus according to claim 10 wherein said applying means also includes strip pressing members spaced from said drawing means for engaging reinforcing strip portions applied to two adjacent containers of two adjacent pairs of containers to interlock applied reinforcing strip portions with container upper portions.

12. Apparatus according to claim 11 wherein said drawing means and said strip pressing members are carried by a common movable support.

13. Apparatus according to claim 11 wherein said severing means is positioned between said strip pressing members.

14. Apparatus for applying a package reinforcing strip to pairs of containers of the type having an upper portion with a peripheral projection, said apparatus comprising perforating means for perforating a reinforcing strip portion, applying means for engaging a perforated strip portion and pressing the same over upper portions of a pair of adjacent containers, severing means for severing an applied strip portion from the remainder of a strip, feed means for continuously advancing containers to which a reinforcing strip is being applied, said applying means being carried by a movable support, and drive means for moving said movable support towards a row of moving containers and with the moving containers at the same rate of advancement.

15. Apparatus according to claim 14 wherein said drive means include a pair of adjacent rotating cranks, support links pivotally connecting said cranks to said movable support, an advancement control crank, a control link pivotally connecting said advancement control crank to said one of said support links, and means for rotating said cranks in unison.

16. Apparatus according to claim 15 wherein said control crank is of the combined crankpin, cam and cam follower type.

17. Apparatus according to claim 14 wherein said perforating means and said securing means are also carried by said movable support.

18. A method of reinforcing a pick-up area of a multipack of containers, said method comprising the steps of providing a reinforcing strip; and repeatedly and simultaneously perforating the strip at constant intervals, applying the perforated strip into overlying relation relative to pairs of containers, and severing the strip between adjacent pairs of containers.

19. The method of claim 18 wherein the applying of the strip is accomplished by drawing the strip down between adjacent pairs of containers.

20. The method of claim 19 and followed by the direct pressing down of the strip over upper portions of the containers.

21. The method of claim 20 wherein said direct pressing down of the strip over upper portions of containers is simultaneously effected with respect to two adjacent containers of two different pairs of containers.

22. The method of claim 21 wherein said severing is effected between the two adjacent containers while the strip is directly pressed down thereover.

23. The method of claim 18 wherein the containers are being continuously moved during the applying of the reinforcing strip.

* * * * *